US006149770A

United States Patent [19]

Hu et al.

[11] Patent Number: 6,149,770

[45] Date of Patent: Nov. 21, 2000

[54] UNDERWIRE WATER WEIGHT TURBULENCE SENSOR

[75] Inventors: Hung-Tzaw Hu, Saratoga, Calif.; Claud Hagart-Alexander, Vancouver, Canada; Lee Chase, Los Gatos; John D. Goss, San Jose, both of Calif.; David Watson, Etobicoke, Canada

[73] Assignee: Honeywell-Measurex Corporation, Cupertino, Calif.

[21] Appl. No.: 09/060,167

[22] Filed: Apr. 14, 1998

[51] Int. Cl.[7] ..... D21F 1/32

[52] U.S. Cl. ..... 162/199; 162/252; 162/253; 162/254; 162/256; 162/257; 162/258; 162/259; 162/DIG. 11; 162/263

[58] Field of Search ..... 162/198, 252, 162/253, 254, 256, 257, 258, 259, 263, DIG. 11; 700/127–129

[56] References Cited

U.S. PATENT DOCUMENTS

| | | | |
|---|---|---|---|
| 3,260,642 | 7/1966 | Canter . | |
| 3,547,775 | 12/1970 | Bossen et al. | 162/DIG. 11 |
| 3,593,128 | 7/1971 | Perry . | |
| 3,620,914 | 11/1971 | Rocheleau | 162/259 |
| 3,630,836 | 12/1971 | Bietry et al. . | |
| 3,636,327 | 1/1972 | Troutman . | |
| 3,646,434 | 2/1972 | Norwich . | |
| 3,649,446 | 3/1972 | Makela | 162/259 |
| 3,654,075 | 4/1972 | Keyes et al. . | |
| 3,655,980 | 4/1972 | Bossen | 162/198 |
| 3,713,966 | 1/1973 | Lippke . | |
| 3,723,712 | 3/1973 | Komline, Sr. et al. . | |
| 3,723,865 | 3/1973 | Batey et al. . | |
| 3,795,984 | 3/1974 | Meyer . | |
| 3,811,087 | 5/1974 | Schmelzer . | |
| 3,864,626 | 2/1975 | MacLean et al. . | |
| 3,986,110 | 10/1976 | Overall et al. . | |
| 4,092,068 | 5/1978 | Lucas et al. | 162/198 |
| 4,135,151 | 1/1979 | Rogers et al. . | |
| 4,152,202 | 5/1979 | DeLigt | 162/DIG. 11 |
| 4,259,632 | 3/1981 | Ahtianen . | |
| 4,314,878 | 2/1982 | Lee . | |
| 4,329,201 | 5/1982 | Bolton . | |
| 4,369,080 | 1/1983 | Johnson . | |
| 4,374,703 | 2/1983 | Lebeau et al. | 162/259 |
| 4,398,996 | 8/1983 | Bolton et al. . | |
| 4,468,611 | 8/1984 | Tward . | |

(List continued on next page.)

FOREIGN PATENT DOCUMENTS

| | | | |
|---|---|---|---|
| 0276106 | 7/1988 | European Pat. Off. . | |
| 2025088 | 1/1980 | United Kingdom | 162/DIG. 11 |

OTHER PUBLICATIONS

Smook, G.A., Handbook for Pulp & Paper Technologist, 2d. ed., (Angus Wilde Publications), 1992, pp. 228–229.

*Primary Examiner*—Peter Chin
*Attorney, Agent, or Firm*—Burns, Doane, Swecker & Mathis, L.L.P.

[57] ABSTRACT

A system and method of providing on-line turbulence measurements in a sheetmaking machine and using these measurements to perform on-line adjustments to turbulence-inducing and adjusting elements in the sheetmaking machine to optimize final sheet product quality. Turbulence measurements are obtained using water weight sensors in the wet-end of the sheetmaking machine and specifically under wire water weight measurements. Water weight readings are correlated to turbulence intensity levels by correlating ranges of water weights to intensity level intervals. A turbulence processing sensor sorts accumulated water weight measurement readings into intensity level intervals to obtain turbulence measurements or a turbulence profile. The turbulence measurements or profile is provided to a machine element controller which uses the measured turbulence information and target turbulence information to generate control signals. The water weight sensors can obtain independent machine direction (MD) and cross direction (CD) water weight measurements and consequently independent turbulence measurements can be determined so that turbulence can be controlled in both directions. Machine elements are controlled so that turbulence remains uniform across the CD and so that the MD turbulence profile is optimized to resemble a target profile

28 Claims, 7 Drawing Sheets .

U.S. PATENT DOCUMENTS 4,474,643 10/1984 Lindblad .
4,514,812 4/1985 Miller et al. .
4,535,285 8/1985 Evans et al. .
4,574,624 3/1986 Lehtinene et al. ..... 162/198
4,580,233 4/1986 Parker et al. .
4,588,943 5/1986 Hirth .
4,613,406 9/1986 Gess. .
4,644,174 2/1987 Ouellette et al. ..... 162/198
4,648,715 3/1987 Ford, Jr. et al. .
4,680,089 7/1987 Aral et al. .
4,692,616 9/1987 Hegland et al. .
4,707,779 11/1987 Hu .
4,748,400 5/1988 Typpo .
4,786,529 11/1988 Boissevain .
4,791,353 12/1988 Typpo .
4,817,021 3/1989 Sowerby et al. .
4,827,121 5/1989 Vidrine, Jr. et al. .
4,840,706 6/1989 Campbell ..... 162/198
4,845,421 7/1989 Howarth et al. .
4,874,467 10/1989 Karlsson et al. ..... 162/DIG. 11
4,903,528 2/1990 Balakrishnan et al. .
4,909,070 3/1990 Smith .
4,921,574 5/1990 Hu .
4,924,172 5/1990 Holmgren .
4,947,684 8/1990 Balakrishnan .
4,957,770 9/1990 Howarth .
4,980,846 12/1990 Chapman .
4,986,410 1/1991 Shields .
4,990,261 2/1991 Ho .
4,994,145 2/1991 Seymour .
5,013,403 5/1991 Chase ..... 162/198
5,020,469 6/1991 Boissevain et al. .
5,021,740 6/1991 Sarr et al. .
5,022,966 6/1991 Hu ..... 162/198
5,045,798 9/1991 Hendrick .
5,052,223 10/1991 Regnault et al. .
5,067,345 11/1991 Mougne .
5,093,795 3/1992 Lewis .
5,104,488 4/1992 Chase ..... 162/198
5,122,754 6/1992 Gotaas .
5,124,552 6/1992 Anderson .
5,132,631 7/1992 Klopfenstein et al. .
5,134,380 7/1992 Jonas .
5,170,128 12/1992 Masurat et al. .
5,170,670 12/1992 Fasching et al. .
5,177,445 1/1993 Cross .
5,198,777 3/1993 Masuda et al. .
5,206,599 4/1993 Mayer .
5,208,544 5/1993 McBrearty et al. .
5,225,785 7/1993 Mayer et al. .
5,241,280 8/1993 Aidun et al. .
5,244,550 9/1993 Inoue .
5,247,261 9/1993 Gershenfeld .
5,262,955 11/1993 Lewis .
5,270,664 12/1993 McMurtry et al. .
5,280,250 1/1994 Jayaweera et al. .
5,340,442 8/1994 Gess et al. .
5,393,378 2/1995 Yakabe et al. ..... 162/259
5,400,247 3/1995 He .
5,450,015 9/1995 Mastico et al. .
5,492,601 2/1996 Ostermayer et al. .
5,493,910 2/1996 Hall et al. .
5,539,634 7/1996 He .
5,552,021 9/1996 Ilvespaa et al. ..... 162/259
5,560,808 10/1996 Graf ..... 162/DIG. 11
5,561,599 10/1996 Lu .
5,563,809 10/1996 Williams et al. .
5,603,806 2/1997 Kerttula ..... 162/198
5,636,126 6/1997 Heaven et al. .
5,658,432 8/1997 Heaven et al. .
5,853,543 12/1998 Hu et al. ..... 162/198
5,891,306 4/1999 Chase et al. ..... 162/198

SPOUT SEPARATION LINE
TURBULENCE INTENSITY
10
8
6
4
2
1
2
3
4
5
6
7
8
HEADBOX
FORMING BOARD
FOILS
WET BOXES
PRIMARY HEADBOX
SECONDARY HEADBOX

UNDERWIRE WATER WEIGHT TURBULENCE SENSOR

BACKGROUND OF THE INVENTION

1. Field of the Invention

The present invention relates to monitoring turbulence in a continuous sheetmaking machine process, and more particularly, to a sensor for monitoring turbulence on the wire of a sheetmaking machine using wet end measurements.

2. State of the Art

In the manufacture of paper using a continuous sheetmaking machine, a web of paper is formed from an aqueous suspension of fibers (stock). Stock is dispersed from a dispensing unit referred to as a headbox onto a traveling mesh wire or fabric and water drains by gravity and vacuum suction through the fabric. The web is then transferred to the pressing section where more water is removed by dry felt and pressure. The web next enters the dry section where steam heated dryers complete the drying process. The sheetmaking machine is essentially a de-watering, i.e., water removal system. In the sheetmaking art, the term machine direction (MD) refers to the direction that the sheet material travels during the manufacturing process, while the term cross direction (CD) refers to the direction across the width of the sheet which is perpendicular to the machine direction. Furthermore, in general, the elements of the system including the headbox, the web, and those sections just before the dryer are referred to as the "wet end". The "dry end" generally includes the sections downstream from the press. Papermaking elements and machines are well known in the art and are described, for example, in "Handbook for Pulp & Paper Technologists" 2nd ed., G. A. Smook, 1992, Angus Wilde Publications, Inc., and "Pulp and Paper Manufacture" Vol III (Papermaking and Paperboard Making), R. MacDonald, ed. 1970, McGraw Hill. Sheetmaking machines are further described, for example, in U.S. Pat. Nos. 5,539,634, 5,022,966 4,982,334, 4,786,817, and 4,767,935.

Sheet formation (i.e., small-scale basis weight variation) is a basic sheet property that has a significant effect on optical and strength properties of the final sheet product. Sheet formation improves when average floc (i.e., grouped masses of particles) size or density decreases. Although, the stock approach system (i.e., elements prior to the headbox which provide the stock) and the headbox are key elements in delivering uniform and maximum dispersed stock, this is usually not adequate to produce a well-formed sheet. In particular what is further needed is defloccuation wherein clumping of the stock particles in a non-uniform manner is minimized. Defloccuation or dispersion can be generated in a number of ways such as by turbulence-inducing elements below the forming wire, by shear inducing elements above the fabric (e.g., dandy roll or top former), or by shaking the wire. Moreover, turbulence-induced in a sheetmaking machine affects particle orientation which also determines sheet strength.

In the art of making paper, sheet properties (such as sheet strength, thickness, and weight) are continually monitored and the sheetmaking machine controlled and adjusted to assure sheet quality and to minimize the amount of finished product that is rejected. This control is performed by measuring sheet properties at various stages in the manufacturing process which most often include basis weight, moisture content, and caliper (i.e., thickness) of the sheet, and using this information to adjust various elements within the sheetmaking machine to compensate for variations in the sheetmaking process.

Typically, a scanning sensor is used to perform basis weight measurements of the finished sheet at the dry end of the sheetmaking machine. Scanning sensors are known in the art and are described, for example, in U.S. Pat. Nos. 5,094,535, 4,879,471, 5,315,124, and 5,432,353. The basis weight measurements obtained from the scanner are used to control elements in the sheetmaking machine to adjust basis weight, and hence, paper quality.

To date, one property that has not been used to monitor on-line paper quality is wire turbulence. Instead, turbulence has been evaluated in an experimental environment to determine its effect on defloccuation and to determine optimum turbulence profiles. In particular, in the article "Turbulence Approach to Optimizing Fourdrinier Performance," by B. A. Thorp and R. A. Reese (Tappi Journal, March 1985, pp:70–73) turbulence is qualified by scale which is based on the number of peaks per unit area and by intensity which is based on the height of the peaks. Since these properties (i.e., scale and intensity) are based entirely on visual attributes, measurement of these properties are performed using equipment that will "stop" stock action to permit observation. Hence in this case, turbulence is evaluated using high intensity strobes and instant cameras with strobe flash units. Once photos are taken, they must be evaluated by a trained individual to count peaks per unit area and evaluate peak height. As can be imagined, turbulence measurements using this method are not immediately available and hence would not be suitable on-line information usable in a production environment. What would be desirable is to obtain on-line turbulence measurements so as to optimize papermaking system parameters in a production environment.

SUMMARY OF THE INVENTION

The present invention is a system and method for measuring water flow turbulence variations at the wet end of a sheetmaking machine and providing on-line control to elements in the system to establish an optimum turbulence profile so as to improve formation and strength of the finished sheet product. The sheetmaking machine is designed with non-scanning sensors which provide simultaneous multiple point wet end, water weight measurements across either/or both of the machine direction (MD) and cross direction (CD) of the sheetmaking machine. These water weight measurements are converted into turbulence measurements or a turbulence profile. The turbulence measurements or profile are used to adjust turbulence adjusting elements in the sheetmaking machine to improve sheet quality. The non-scanning sensors obtain independent MD and CD water weight measurements and hence can independently monitor and adjust turbulence in each of the cross and machine directions.

The turbulence measurements are determined by relating water weight measurements to turbulence intensity. Accumulated water weight measurement readings from each sensor are sorted into predefined intervals of intensity in which each interval corresponds to a range of water weight. Intensity intervals range from low to high intensity where lower range intensity intervals correlate to lower water weight measurements while higher range intensity intervals correlate to higher water weight measurements. A count of the number of readings per interval is evaluated to obtain the turbulence measurement. In one embodiment, a predetermined number of water weight measurements taken by each sensor are divided into ten intervals of intensity, each interval correlating to a particular range of measured water weight. In still another embodiment, a single turbulence value is obtained by weighting intervals and adding all intervals to obtain a single value.

In one embodiment, the turbulence measurements provided from more than one sensor are processed to obtain an on-line turbulence profile. In particular, the turbulence measurement from sensors in the CD, MD, or in an array configuration are used to generate a CD, MD, or three-dimensional profile of turbulence. A previously determined optimized target turbulence profile is compared to the measured on-line profile to obtain an error signal which is used as a feed back signal to control system operating variables.

In a particular embodiment, a row of sensors is placed down each side of the wire and down the middle to obtain water weight measurements so as to generate turbulence measurements. In one embodiment, the wet end sensors are under wire water weight ($UW^3$) sensors which are responsive to changes in conductivity of the aqueous stock material at the wet end of the system.

In a measurement system embodiment, water weight measurements are provided to a turbulence sensor processor for generating turbulence measurements. The turbulence measurements are provided to at least one controller which, in response, provides on-line control signals for adjusting operating variables of the turbulence adjusting sheetmaking machine elements. In one embodiment, operating variables that can be adjusted by the on-line control signals include headbox pressure, headbox flow, headbox dilution, headbox airpad, and jet-to-wire ratio, slice geometry, slice lip "stick-down" position, machine speed, forming board position, amount of wire shake, and vacuum effect and position of drainage vacuum elements such as foils or vacuum boxes.

BRIEF DESCRIPTION OF THE DRAWINGS

The present invention may be further understood from the following written description in conjunction with the appended drawings. In the drawings.

DETAILED DESCRIPTION OF THE PREFERRED EMBODIMENTS

The present invention is a system and method of obtaining on-line turbulence measurements and providing on-line control of turbulence adjusting elements in a sheetmaking machine to maintain good sheet formation.

Figure 1:
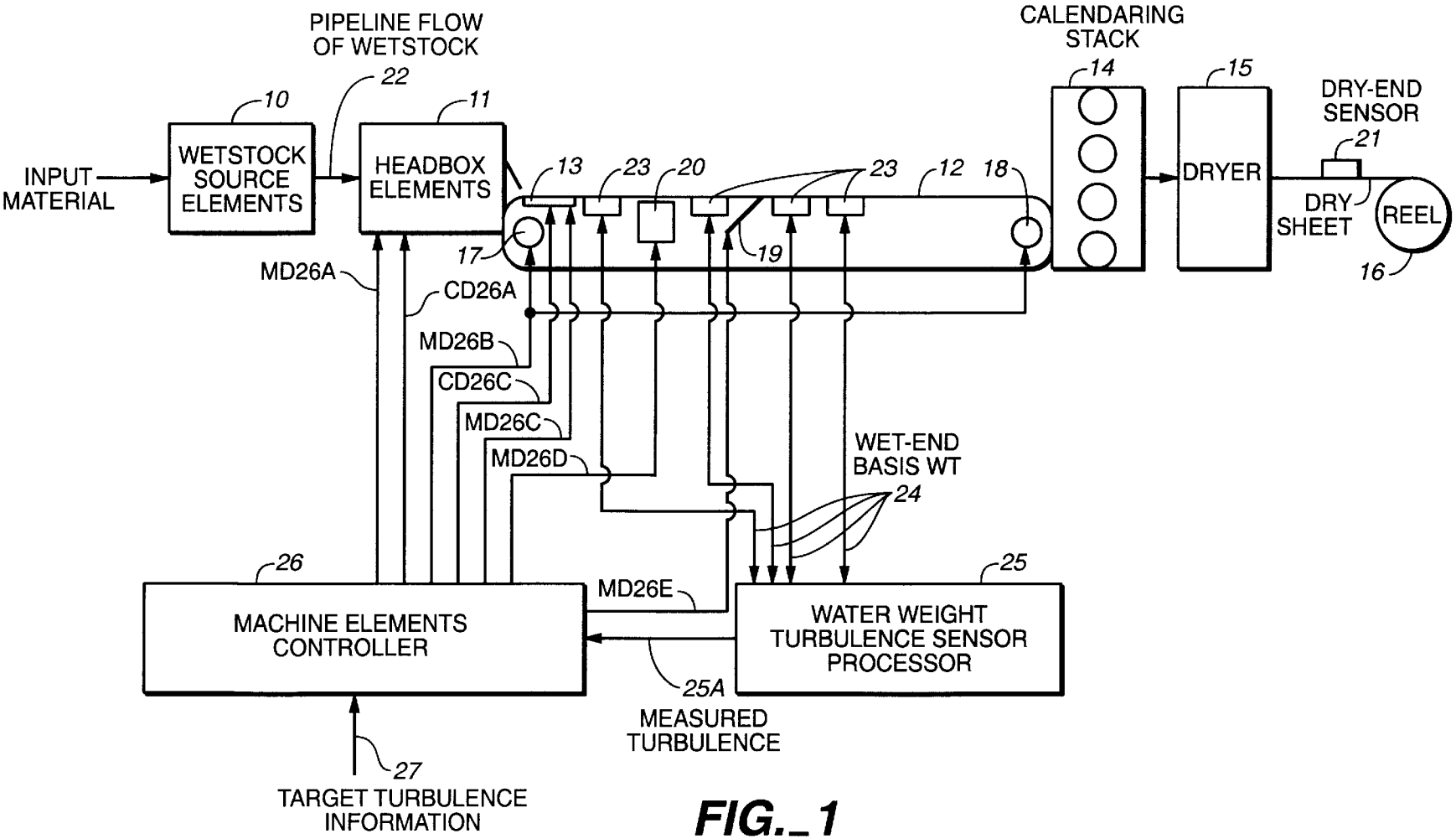
FIG. 1 is a sheetmaking machine including one embodiment of the control system of the present invention.

FIG. 1 shows a sheetmaking machine for producing a continuous sheet of material that comprises processing stages including wetstock source elements 10, headbox 11, web or wire 12, forming board 13, calendering stack 14, dryer 15, and reel 16. Actuators (not shown) in headbox 11 discharge wetstock (e.g., pulp slurry) through a plurality of orifices referred to as slices onto supporting wire 12 which rotates between rollers 17 and 18. The speed at which the stock is discharged from the slice is called the slice jet velocity. The slice is completely adjustable to give the desired rate of stock flow. The slice geometry and opening determine the thickness of the slice jet, while the headbox pressure determines the velocity. Foil 19 and vacuum box 20 remove water, commonly known as "white water", from the wetstock on the wire into a wire pit (not shown) for recycle. Dry end BW measurements can be performed using scanning sensor 21 or using a $UW^3$ sensor (as described herein). A scanning sensor 21 continuously traverses the finished sheet (e.g., paper) and measures properties to monitor the quality of the finished sheet. Multiple stationary sensors can also be used. Scanning sensors are known in the art and arc described, for example, in U.S. Pat. Nos. 5,094,535, 4,879,471, 5,315,124, and 5,432,353, which are incorporated herein. The finished sheet is collected on reel 16.

A plurality of sensors 23 provide multiple point simultaneous wet end water weight measurements independently in either/or both the machine direction (MD) and the cross direction (CD) in the wet end of a sheetmaking machine. The plurality of sensors detect changes in physical properties of the wetstock suspension traveling on a wire in the machine direction of the sheetmaking machine. The changes in detected physical properties are converted to water weight measurements 24 by sensors 23 which, in turn, are correlated to intervals of turbulence intensity level by water weight turbulence sensor processor 25. The turbulence measurement signal 25A is then provided to machine element controller 26. Controller 26 generates control signals (e.g., CD26C, MD26C, MD26D, MD26E, MD26A, CD26A, and MD26B) to control operating variables of machine elements affecting turbulence in the sheetmaking machine depending on predetermined target turbulence information 27.

It should be noted that the position of the sensors shown in FIG. 1 relative to the wire 12 between rolls 17 and 18 is not indicative of a specific placement. Instead, the sensors can be placed anywhere along the wire in which the wetstock is in a state such that all or most of the water is held by the fiber in the wetstock. Sensors can be arranged into an array of sensor cells or individually in either of the cross or machine directions. For instance, sensor cells can be configured in a CD array, further described herein. In this case, each sensor cell in an array is positioned below a portion of the wire in the cross direction which supports the wetstock. In one embodiment, a row of individual machine direction (MD) sensors are placed along each side of the array and down the middle of the array. A profile made up of a multiplicity of water weight measurements at different locations can be developed and used to determine a turbulence profile.

It should be noted that the term "water weight" refers to the mass or weight of water per unit area of the wet paper stock which is on the wire. Typically, the sensors when positioned under the wire are calibrated to provide engineering units of grams per square meter (gsm). As an approximation, a reading of 10,000 gsm corresponds to paper stock having a thickness of 1 cm on the fabric.

In one embodiment of the present invention turbulence sensor processor 25 correlates water weight measurements into turbulence measurements by accumulating water weight measurement readings from each sensor during a given measurement time period. For instance, in the case in which three sensors reside along the side of the wire in the machine direction, each are providing many water weight readings to turbulence sensor processor 25. In one embodiment in which under wire water weight ($UW^3$) sensors (as described herein) are used, 1000 measurement readings per second, however it should be understood that the number of readings can be more or less than 1000 readings per second in other embodiments. Turbulence ranges (or intervals) of intensity are defined in terms of ranges of water weight. For instance, 10 intervals of turbulence intensity are defined such that each range corresponds to a range of water weight. The intensity intervals range from the highest intensity interval which corresponds to the heaviest water weight range to the lowest intensity interval which corresponds to the lightest range of water weight. A predetermined number of water weight measurement readings (in this example 1000) are sorted into each of the intensity readings. For instance, if the predetermined number of readings is 1000, then each of the 1000 measurements are sorted into an intensity level interval according to their weight. Table 1 illustrates water weight measurement readings that are sorted according turbulence intensity interval/weight range.

TABLE 1

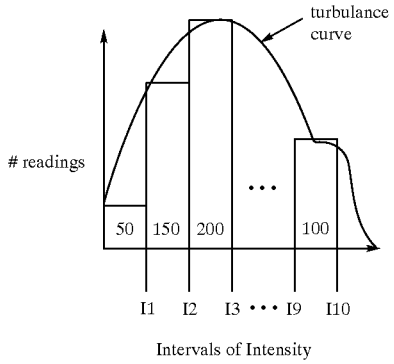

I1 = water wt. 0 − water wt. 1
I2 = water wt. 1 − water wt. 2
I3 = water wt. 2 − water wt. 3
.
.
.
I10 = water wt. 9 − water wt. 10
where water wt. (n) > water wt. (n + 1)

As can be seen in Table 1 each interval has a corresponding number of measurement readings (also referred to as a count or scale). For instance interval 1 (the lowest intensity level) has a count of 50 measurement readings. Interval 1 corresponds to weights that fall in the range of $Wt_0$ through $Wt_1$. The turbulence curve shown in Table 1 represents the turbulence profile at the location of the sensor during the measurement time period in which the 1000 measurement readings were taken.

It should be noted that in one embodiment the total range of weight of all of the intervals is based on the normalized average of the total number of measurement readings taken (e.g. 1000 readings), a maximum weight measurement reading, a minimum weight measurement reading, and the amount of turbulence seen by a given sensor. As a result, the range can be different for each sensor. For instance, the amount of turbulence (and hence water weight) measured closer to the headbox, and in particular the forming board, is typically greater than the turbulence seen at the end of the wire. Hence, a sensor positioned close to the headbox measures significantly greater weights than a sensor farther down the wire towards the dry end. Consequently, in one embodiment each sensor's weight range is set according to its position along the wire and average weight measured during a given measurement time period.

One manner in which to determine the total weight range for a given sensor is to first determine an average weight measured by a given sensor. For instance, a given sensor may take 1000 readings having a given average weight during a measurement time period. After determining the average weight, a maximum weight (e.g. $10^{th}$ interval weight, Table 1) and a minimum weight (e.g. $1^{st}$ interval weight, Table 1) is selected. In one embodiment the selected minimum weight of the total weight range is open-ended, while the selected maximum weight of the total weight range corresponds to the measured maximum weight. The middle interval weight (e.g. $5^{th}$ interval weight, Table 1) corresponds to the determined average weight of the total readings (e.g. 1000 readings). The total range can be constantly adjusted for each measurement time period, however, in general, a given sensor will typically maintain a given range due to its location if no other parameters in the sheetmaking system are adjusted.

In one embodiment of a sheetmaking machine using the turbulence control system shown in FIG. 1, wire 12 is traveling at a speed of 2000 ft/min (approximately 33 ft/sec) and 1000 measurement readings are taken per second. For each 1000 measurement readings taken, 0.4 inch of the sheet passes over the sensor and consequently, for each measurement reading taken which occurs in 10 microseconds, 0.004 inch of the sheet passes over the sensor. The portion of the sheet being measured during the 10 microseconds corresponds to the geometry of the sensor taking the readings which resides below the wire.

Once sorted, the count of readings per intensity level interval is evaluated by turbulence sensor processor 25 so as to generate a turbulence measurement signal 25A. It should be understood that Table 1 illustrates the manner in which data is sorted, however, it should be further understood that this table need not be generated in order to correlate the water weight measurements into turbulence measurement readings.

The turbulence measurement signal 25A represents many forms of turbulence information which depend on the manner in which the correlated turbulence intensity level readings are evaluated and processed by turbulence sensor processor 25. For instance, in one embodiment, signal 25A provides the turbulence curve (see Table 1) from each sensor for the measurement time period. This information is then processed by controller 26 to generate control CD and MD control signals.

In another embodiment, turbulence measurement readings are obtained by a row of MD sensors during a measurement time period in which each sensor simultaneously obtains a set of turbulence measurement readings such as shown in Table 1. The measurement readings taken from each sensor during the measurement time period is processed so as to generate a single turbulence intensity value representing an intensity level of turbulence at that sensor in that time period. The collection of single turbulence intensity values from each MD sensor is then used to generate an MD turbulence profile for that time period. One manner in which to process the turbulence measurement readings from a single sensor collected during the measurement time period to obtain a single turbulence intensity value is to weight the contribution of certain of the intensity intervals shown in Table 1, and then add all of the intensity counts to obtain a single value as shown in the equation below:

$$I=W_1(I_1\text{count})+W_2(I_2\text{count})+W_3(I_3\text{count}) \ldots +W_{10}(I_{10}\text{count})$$

where $I_1$ count . . . $I_{10}$ count are the number of readings falling into each of the intensity intervals and $W_1 \ldots W_{10}$ are each intensity interval's weighting factor. For intervals in which the most common turbulence occurs, the weighting factor is high. Whereas, extremely high or low turbulence intensity interval readings which are of no interest and rarely occur will have a low weighting factor. The single value obtained from each sensor for that measurement period is then used to generate a profile in the MD direction.

An alternative manner in which to determine a single turbulence value is to determine the root mean square (RMS) of the water weight measurements obtained from each sensor within the measurement time period to obtain an average water weight value and then correlate that value to an intensity range depending on its weight.

In one embodiment which includes three rows of sensors in the MD direction, one on each side of the wire and one down the middle of the wire, a three dimensional turbulence profile can be obtained. Finally a row of sensors can be placed across the wire in the CD direction to obtain a CD turbulence profile.

In another embodiment, the sensors are embodied as small arrays of sensor cells at each sensor location (e.g., sensor locations 23, FIG. 1). For instance, sensor 23 in FIG. 1 in accordance with this embodiment would comprise a small array of sensor cells.

Figure 2:
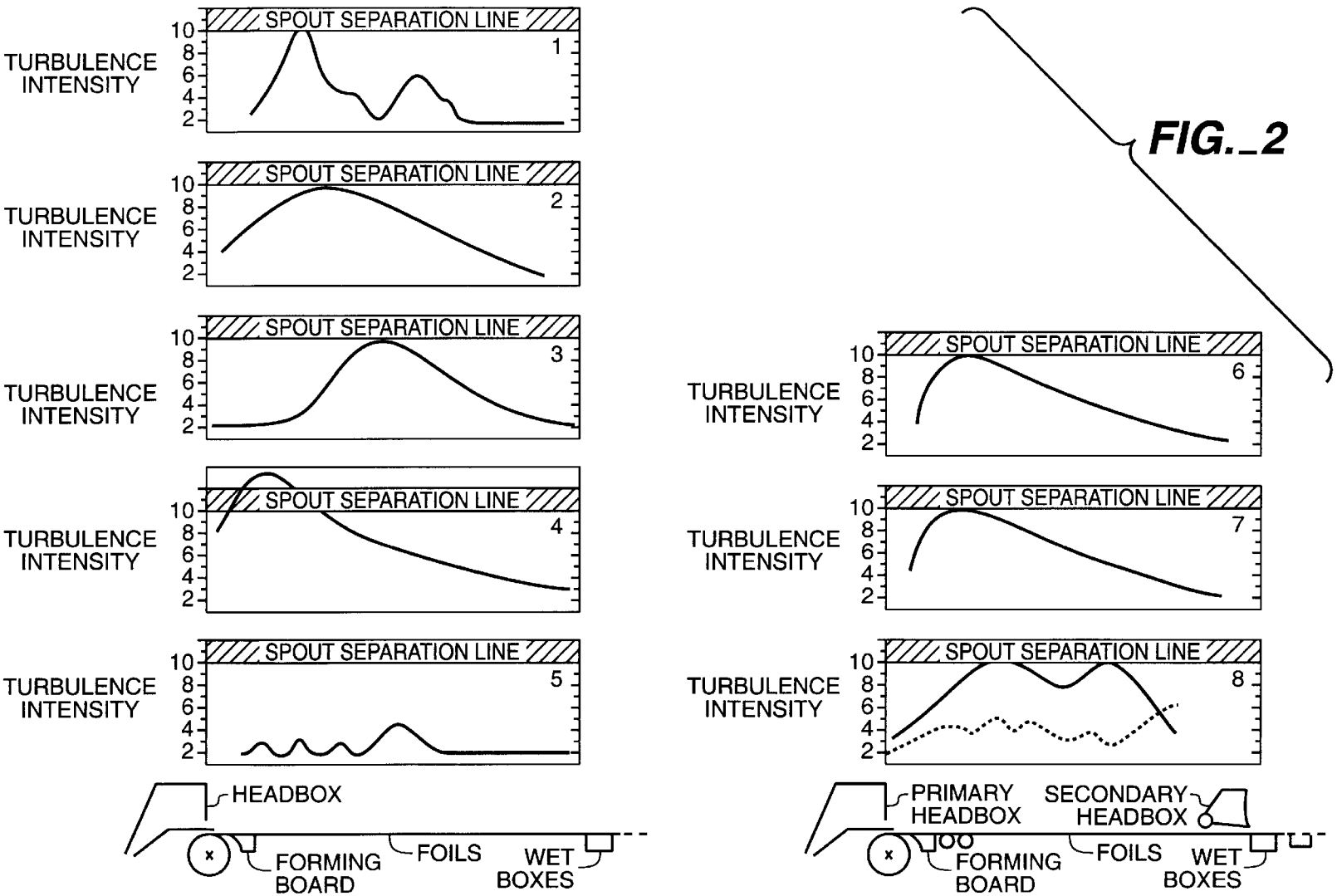
FIG. 2 shows examples of prior art optimized turbulence profiles.

The advantage of obtaining various profiles (e.g., MD, CD) is that each have different turbulence requirements. For instance, in general, an optimum MD turbulence profile has a higher turbulence initially at the beginning of the wire which peaks and then decays as it approaches the end of the wire. FIG. 2 shows various optimum MD turbulence profile examples which where developed by B. A. Thorp and R. A. Reese in "Turbulence Approach to Optimizing Fourdrinier Performance" (Tappi Journal, March 1985, pp.70–73). The optimum CD turbulence profile, in contrast is uniform across the sheet.

FIG. 1 shows control signals CD26A, MD26A, MD26B, CD26C, MD26C, MD26D, MD26E generated by machine element controller 26 in response to the measured turbulence signal 25A and target turbulence information 27. FIG. 2 shows examples of optimized profiles that can be used for target turbulence information 27. As shown, turbulence profiles are optimized for different system types, sheet weights, operating conditions etc. It should be noted that other turbulence profiles may be developed other than those shown in FIG. 2. It should also be understood that target information 27 may be embodied as a single turbulence measurement value instead of a profile. Using a target turbulence profile or measurement value (i.e., target turbulence information 27) and an actual measured turbulence profile or measurement value (i.e., turbulence signal 25A) an error signal is determined by controller 26 which in turn is converted into control signals MD26A-E and CD26A and C. It should be understood that the MD and CD control signals shown in FIG. 1 are representative of, in some cases, more than one control signal provided by controller 26. For instance, control signal CD26A represents all cross directional control signals for controlling the headbox. Consequently, although it is shown in FIG. 1 as a single signal, CD26A actually represents all control signals to the headbox for controlling turbulence in the cross direction.

Some sheetmaking machine elements that can be controlled by controller 26 to adjust turbulence include the headbox, the forming board, the wire, and the drainage vacuum elements. Each of these elements have operating variables that can be adjusted so as to adjust the turbulence created in the sheetmaking machine.

Headbox operating variables that can be controlled to adjust turbulence include headbox dilution, headbox pressure, headbox flow, headbox air pads, and jet-to-wire ratio.

Headbox stock dilution is varied by raising and lowering the slice opening of the headbox. Since the wetstock material addition rate is typically controlled only by the basis weight valve (not shown) which feeds the headbox, a change in slice opening mainly affects the amount of white water circulated from the wire pit. The addition of more white water can increase turbulence. Hence, adjusting slice opening is one manner in which to adjust turbulence. The CD headbox turbulence control signal CD26A is provided to headbox slices to affect cross-direction (CD) turbulence. In this case, the control signal represents a plurality of control signals for independently adjusting each of the plurality of slices to control CD turbulence. In one embodiment, the plurality of headbox slices each have associated actuators which are controlled by each of the control signals which adjust the slice opening size thereby independently adjusting the dilution of the wetstock in the CD direction for each slice segment and hence CD turbulence. The CD turbulence is adjusted to be constant across the CD of the machine.

In a similar manner, the MD turbulence control signal MD26A controls a gross slice opening adjustment to adjust turbulence. In other words, the MD control signal is coupled to all of the slice opening actuators so as to open or close all slices by the same amount to adjust MD turbulence.

Figure 8A:
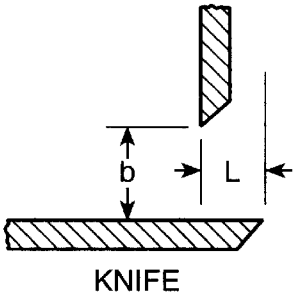
FIGS. 8A–8C show various slice designs.
Figure 8B:
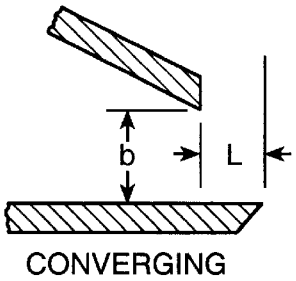
Figure 8C:
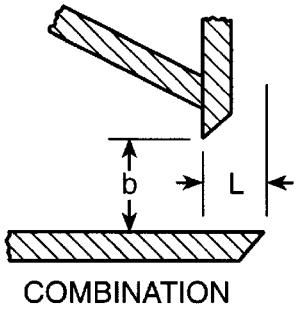

The headbox slice geometry can also affect the turbulence. In particular, every slice has a top lip and an apron (bottom lip). FIGS. 8A–8C shows various slice designs. The top lip is adjustable up or down which determines the b geometry (i.e. the slice opening between the vertical lip and end of apron) and the apron is adjustable in the horizontal direction which determines the geometry L (i.e. the projection of the apron beyond the inner surface). The L/b ratio of the slice (also referred to as the slice geometry) affects the impingement angle of the stock on the wire and hence affects turbulence. Consequently, turbulence can be adjusted by adjusting individual or all slice geometries using control signals CD26A.

Figure 9:
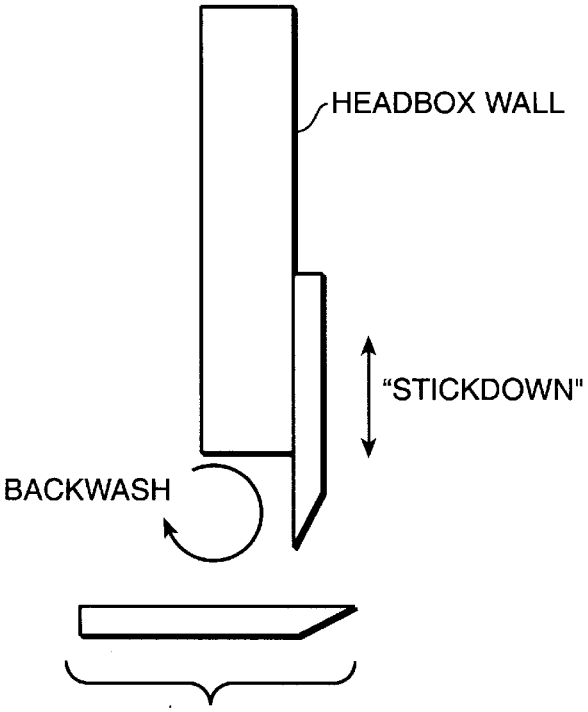
FIG. 9 shows the "stickdown" of a slice.

Another manner in which to affect turbulence is to adjust the "stickdown" of the upper slice lip. Referring to FIG. 9, "stickdown" corresponds to how far the edge of the upper lip protrudes beyond the wall of the headbox. The "stickdown" has the effect of causing a backwash eddy which provides shear force turbulence. Hence, adjusting the upper lip of individual or all slices up or down with control signals CD26A can be used to adjust turbulence.

In another embodiment, the MD control signal is used to control headbox total dilution flow by diluting the wetstock with recycled water that has drained from the wire during the formation process thereby affecting turbulence. In this case, the MD control signal MD26A controls a white water intake valve which determines the amount of white water routed from the wire pit under the wire which is used to dilute the wetstock in the headbox.

The jet-to-wire ratio also impacts turbulence since the jet-to-wire ratio determines the force at which the jet impinges the wire. The jet-to-wire ratio can be changed by adjusting the wire speed or the jet speed.

The wire speed is typically adjusted by changing the speed of the large rolls (17 and 18) at the beginning and end of the wire which it travels on. Often times the couch roll, (i.e., the end roll) controls the speed of the wire. Hence, in another embodiment of the control system shown in FIG. 1, the MD control signal MD26B is coupled to and provides control to the electromechanical control system for driving rolls 17 and/or 18 so as to adjust the driver speed thereby adjusting the jet-to-wire ratio.

The jet speed is not actually measured, but is inferred from the headbox pressure. Consequently, the jet speed is adjusted by fluctuating the headbox pressure. Headbox pressure and consequently jet speed is adjusted depending on headbox type. Specifically, open headboxes (i.e., non pressurized) rely on the height of the stock in the box to determine the pressure and hence the jet speed. Hence, in the case of open headboxes (i.e., non pressurized) control signal MD26A adjusts the level of wetstock in the headbox by controlling the wetstock intake valve.

Pressurized headboxes are adjusted differently than open boxes. There are at least two types of pressurized-type headboxes including hydraulic and air cushioned. The pressure in the hydraulic pressurized headbox is directly dependent on the feeding pump pressure and hence headbox pressure (and turbulence) are adjusted by changing the pump pressure. Hence, to adjust the pressure in the hydraulic pressurized headbox, the MD control signal MD26A adjusts pump speed which in turn changes pump pressure of the feeding pump.

Alternatively, in an air cushioned pressurized headbox, the pressure is dependent on the feeding pump pressure as well as the air in the space above the stock (referred to as the "air pad ") in the closed headbox. The "air pad " is adjusted by opening a regulator value to allow more air to enter or by increasing the level of the stock. Consequently, turbulence can be adjusted in an air cushioned pressurized headbox by applying control signal MD26A to the regulator valve to adjust the air pad, by adjusting the level of stock via controlling the basis weight valve with control signal MD26A, or by adjusting pump speed with control signal MD26A.

The forming board in a sheetmaking system functions to sustain the initial impact of the jet impinging on the wire. The forming board also determines the amount of initial drainage that occurs, depending on its angle with respect to the wire. In general, less drainage means more dilution (i.e., more liquid) in the wetstock. More liquid allows for more turbulence. Alternatively, more drainage means less liquid and less turbulence. Hence, in one embodiment of the control system of the present invention, turbulence control signals MD26C and CD26C are used to adjust the angle of the forming board to control drainage and hence turbulence. In a particular embodiment of the present invention, hydraulic lifters mechanically attached to the forming board are controlled by control signal MD26C and CD26C to adjust the forming board angle. The angle can be adjusted in the MD so as to adjust the overall angle of the forming board to the wire with the MD26C control signal. The angle in the CD can also be adjusted with the CD26C control signal. For instance, one side of the forming board may be raised higher than the other side of the forming board.

Vacuum boxes residing under the wire can be adjusted to remove more or less liquid to adjust turbulence by increasing and decreasing vacuum power. Hence, in another embodiment of the control system shown in FIG. 1, control signal MD26D controls the vacuum power of the vacuum boxes to adjust turbulence.

Foils can also be adjusted to affect turbulence. Specifically, the angle of the foil with respect to the wire can be adjusted to create more or less turbulence. In addition, foils also function to create a vacuum beneath the wire. As a result, foil angles can be adjusted to create more or less vacuum causing more or less liquid drainage so as to decrease or increase turbulence. Hence, in another embodiment of the control system shown in FIG. 1 control signal MD26E controls the angle of the foils to adjust turbulence.

Increasing and decreasing the speed of the sheetmaking machine also affects turbulence. The machine speed can be adjusted by adjusting the speed of both the jet and the wire such that the jet-to-wire ratio is preserved but the overall speed of the machine is increased or decreased. In this case, control signals MD26B (for adjusting wire speed) and MD26A (for adjusting jet speed) are used to adjust turbulence. As described above, the jet speed is indirectly adjusted by adjusting the headbox pressure and the wire speed is adjusted by the electro-mechanical control system for driving rolls 17 and/or 18.

Turbulence can also be created by shaking the wire of the sheetmaking machine. Hence, in another embodiment of the present invention, control signal MD26B is used to control how much the wire is shaken to obtain a desired amount of turbulence.

Under Wire Water Weight ($UW^3$) Sensor

Figure 3B:
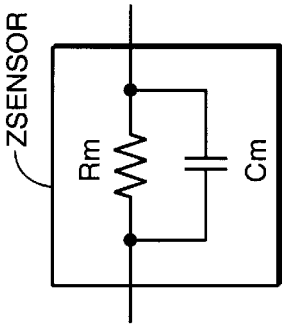
FIG. 3B is an electrical representation of sensor cell impedance.
Figure 3A:
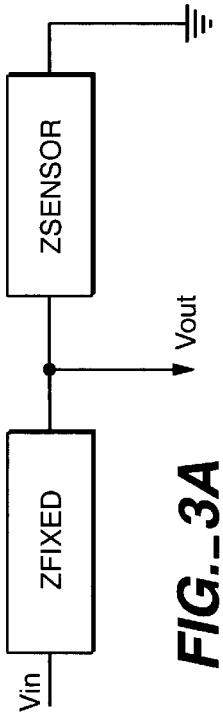
FIG. 3A is a block diagram illustrating impedance in the measurement apparatus.

In its broadest sense, the sensor can be represented as a block diagram as shown in FIG. 3A, which includes a fixed impedance element (Zfixed) coupled in series with a variable impedance block (Zsensor) between an input signal (Vin) and ground. The fixed impedance element may be embodied as a resistor, an inductor, a capacitor, or a combination of these elements. The fixed impedance element and the impedance, Zsensor, form a voltage divider network such that changes in impedance, Zsensor, results in changes in voltage on Vout. The impedance block, Zsensor, shown in FIG. 3A is representative of two electrodes and the material residing between the electrodes. The impedance block, Zsensor, can also be represented by the equivalent circuit shown in FIG. 3B, where Rm is the resistance of the material between the electrodes and Cm is the capacitance of the material between the electrodes. The sensor is further described in U.S. patent application Ser. No. 08/766,864 filed on Dec. 13, 1996, which is incorporated herein.

As described above, wet end BW measurements can be obtained with one or more $UW^3$ sensors. Moreover, when more than one is employed, preferably the sensors are configured in an array of sensor cells. However, in some cases when an array does not physically fit in a location in the sheetmaking machine, a single sensor cell may be employed.

The sensor is sensitive to three physical properties of the material being detected: the conductivity or resistance, the dielectric constant, and the proximity of the material to the sensor. Depending on the material, one or more of these properties will dominate. The material capacitance depends on the geometry of the electrodes, the dielectric constant of the material, and its proximity to the sensor. For a pure dielectric material, the resistance of the material is infinite (i.e., Rm=4) between the electrodes and the sensor measures the dielectric constant of the material. In the case of highly conductive material, the resistance of the material is much less than the capacitive impedance (i.e. $Rm*Z_{cm}$), and the sensor measures the conductivity of the material.

To implement the sensor, a signal Vin is coupled to the voltage divider network shown in FIG. 3A and changes in the variable impedance block (Zsensor) is measured on Vout. In this configuration the sensor impedance, Zsensor, is: Zsensor=Zfixed*Vout/(Vin−Vout) (Eq. 1). The changes in impedance of Zsensor relates physical characteristics of the material such as material weight, temperature, and chemical composition. It should be noted that optimal sensor sensitivity is obtained when Zsensor is approximately the same as or in the range of Zfixed.

Cell Array

Figure 4:
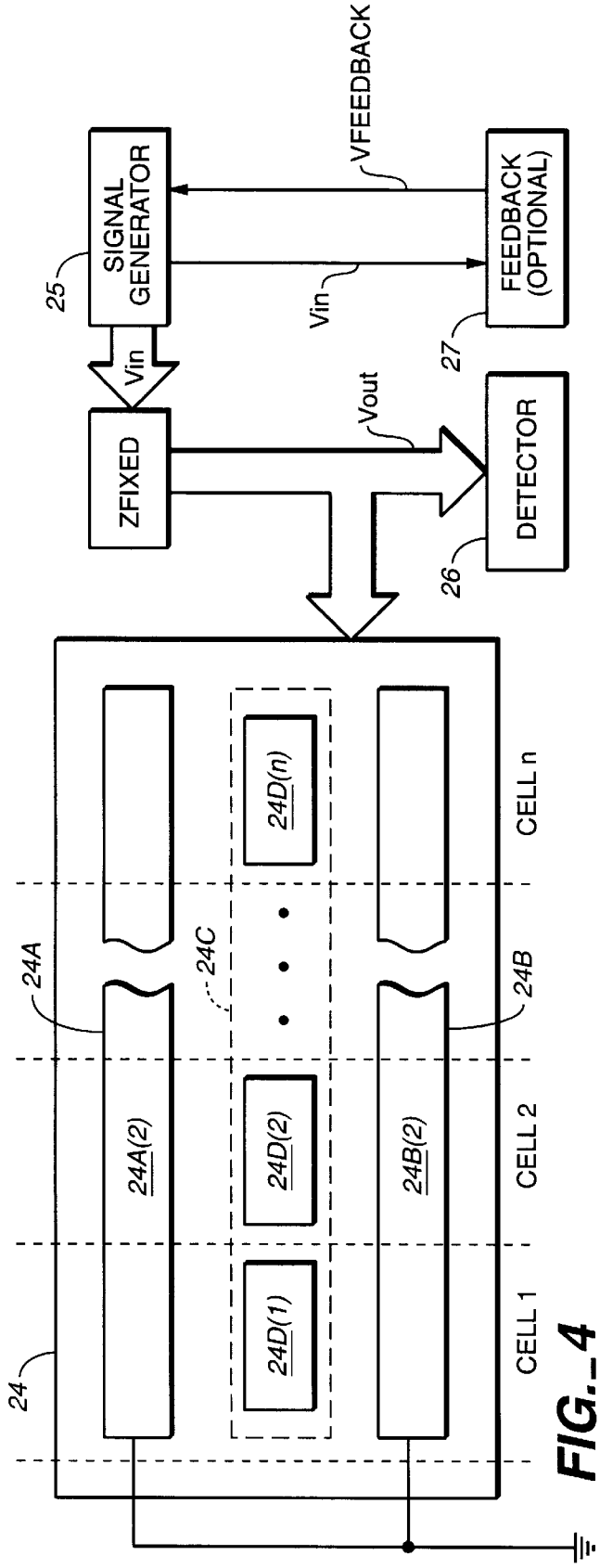
FIG. 4 shows a block diagram of a measurement apparatus including a sensor array in accordance with the present invention.

FIG. 4 illustrates a block diagram of one implementation of the sensor apparatus including cell array 24, signal generator 25, detector 26, and optional feedback circuit 27. Cell array 24 includes two elongated grounded electrodes 24A and 24B and center electrode 24C spaced apart and centered between electrodes 24A and 24B and made up of sub-electrodes 24D(1)–24D(n). A cell within array 24 is defined as including one of sub-electrodes 24D situated between a portion of each of the grounded electrodes 24A and 24B. For example, cell 2 includes sub-electrode 24D(2) and grounded electrode portions 24A(2) and 24B(2). For use in the system as shown in FIGS. 1 and 2, cell array 24 resides beneath and in contact with supporting web 12 and can be positioned either parallel to the machine direction (MD) or to the cross-direction (CD) depending on the type of information that is desired. In order to use the sensor apparatus to determine the weight of fiber in a wetstock mixture by measuring its conductivity, the wetstock must be in a state such that all or most of the water is held by the fiber. In this state, the water weight of the wetstock relates directly to the fiber weight and the conductivity of the water weight can be measured and used to determine the weight of the fiber in the wetstock.

Each cell is independently coupled to an input voltage (Vin) from signal generator 25 through an impedance element Zfixed and each provides an output voltage to voltage detector 26 on bus Vout. Signal generator 25 provides Vin. In one embodiment Vin is an analog waveform signal, however other signal types may be used such as a DC signal. In the embodiment in which signal generator 25 provides a waveform signal it may be implemented in a variety of ways and typically includes a crystal oscillator for generating a sine wave signal and a phase lock loop for signal stability. One advantage to using an AC signal as opposed to a DC signal is that it may be AC coupled to eliminate DC off-set.

Detector 26 includes circuitry for detecting variations in voltage from each of the sub-electrodes 24D and any conversion circuitry for converting the voltage variations into useful information relating to the physical characteristics of the aqueous mixture. Optional feedback circuit 27 includes a reference cell also having three electrodes similarly configured as a single cell within the sensor array. The reference cell functions to respond to unwanted physical characteristic changes in the aqueous mixture other than the physical characteristic of the aqueous mixture that is desired to be measured by the array. For instance, if the sensor is detecting voltage changes due to changes in water weight, the reference cell is configured so that it measures a constant water weight. Consequently, any voltage/conductivity changes exhibited by the reference cell are due to aqueous mixture physical characteristics other than weight changes (such as temperature and chemical composition). The feedback circuit uses the voltage changes generated by the reference cell to generate a feedback signal (Vfeedback) to compensate and adjust Vin for these unwanted aqueous mixture property changes (to be described in further detail below). The non-weight related aqueous mixture conductivity information provided by the reference cell may also provide useful data in the sheetmaking process.

Individual cells within sensor 24 can be readily employed in the system of FIGS. 1 and 2 so that each of the individual cells (1 to n) corresponds to each of the individual $UW^3$ sensors in the machine or cross direction. The length of each sub-electrode (24D (n)) determines the resolution of each cell. Typically, its length ranges from 1 in. to 6 in.

The sensor cells are positioned underneath the web, preferably upstream of the wet line, which on a fourdrinier, typically is a visible line of demarcation corresponding to the point where a glossy layer of water is no longer present on the top of the stock.

A method of constructing the array is to use a hydrofoil or foil from a hydrofoil assembly as a support for the components of the array. In a preferred embodiment, the grounded electrodes and center electrodes each has a surface that is flushed with the surface of the foil.

Figure 5A:
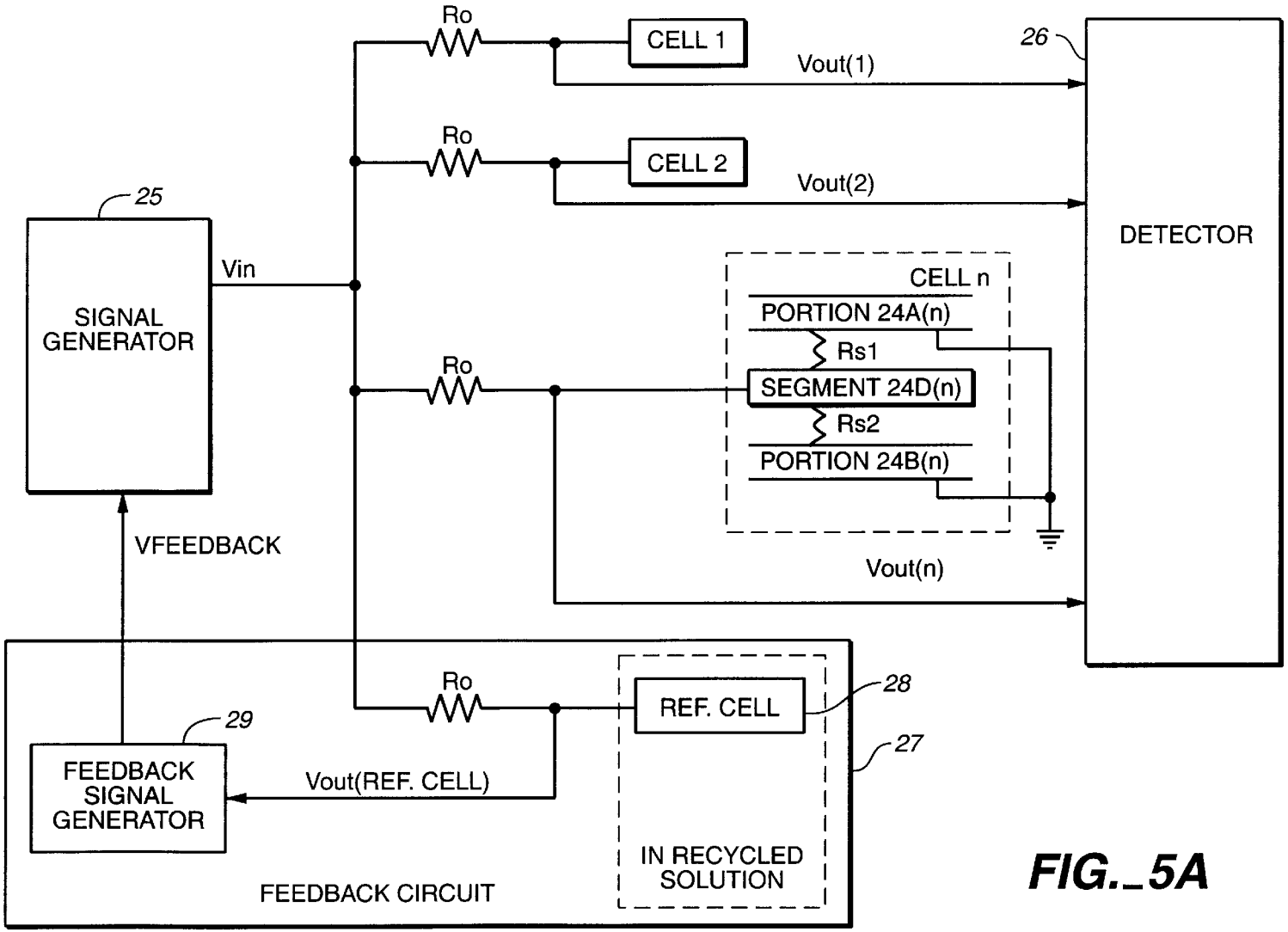
FIG. 5A shows an electrical representation of the block diagram shown in FIG. 4.
Figure 5B:
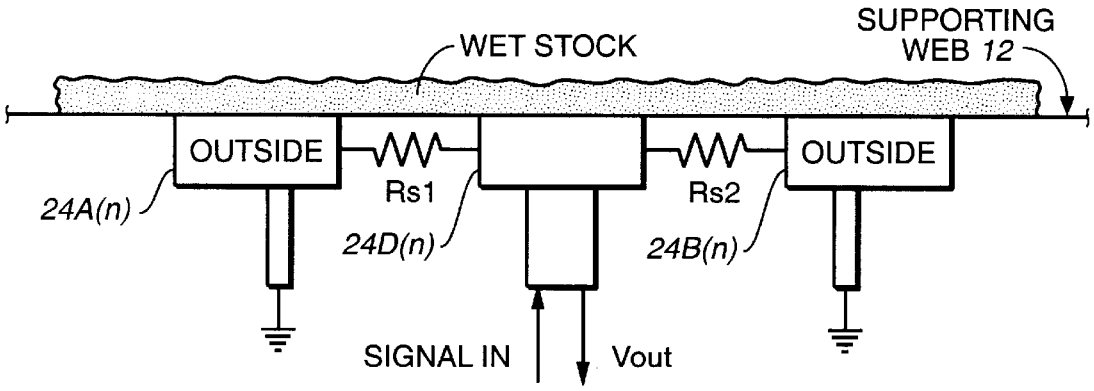
FIG. 5B shows a single sensor cell residing beneath a sheetmaking machine supporting web in accordance with the measurement apparatus of the present invention.

FIG. 5A shows an electrical representation of sensor cell array 24 (including cells 1–n) and the manner in which it functions to sense changes in conductivity of an aqueous mixture (i.e., wetstock). As shown, each cell is coupled to Vin from signal generator 25 through an impedance element which, in this embodiment, is resistive element Ro. Referring to cell n, resistor Ro is coupled to the center sub-electrode 24D(n). The outside electrode portions 24A(n) and 24B(n) are both coupled to ground. Also shown in FIG. 5A are resistors Rs1 and Rs2 which represent the conductance of the aqueous mixture between each of the outside electrodes and the center electrode. The outside electrodes are designed to be essentially equidistant from the center electrode and consequently the conductance between each and the center electrode is essentially equal (Rs1=Rs2=Rs). As a result, Rs1 and Rs2 form a parallel resistive branch having an effective conductance of half of Rs (i.e. Rs/2). It can also be seen that resistors Ro, Rs1, and Rs2 form a voltage divider network between Vin and ground. FIG. 5B also shows the cross-section of one implementation of a cell electrode configuration with respect to a sheetmaking machine in which electrodes 24A(n), 24B(n), and 24D(n) reside directly under the web 12 immersed within the aqueous mixture.

The sensor apparatus is based on the concept that the resistance Rs of the aqueous mixture and the weight/amount of an aqueous mixture are inversely proportional. Consequently, as the weight increases/decreases, Rs decreases/increases. Changes in Rs cause corresponding fluctuations in the voltage Vout as dictated by the voltage divider network including Ro, Rs1, and Rs2.

The voltage Vout from each cell is coupled to detector 26. Hence, variations in voltage directly proportional to variations in resistivity of the aqueous mixture are detected by detector 26 thereby providing information relating to the weight and amount of aqueous mixture in the general proximity above each cell. Detector 26 may include means for amplifying the output signals from each cell and in the case of an analog signal will include a means for rectifying the signal to convert the analog signal into a DC signal. In one implementation well adapted for electrically noisy environments, the rectifier is a switched rectifier including a phase lock-loop controlled by Vin. As a result, the rectifier rejects any signal components other than those having the same frequency as the input signal and thus provides an extremely well filtered DC signal. Detector 26 also typically includes other circuitry for converting the output signals from the cell into information representing particular characteristics of the aqueous mixture such as weight.

FIG. 5A also shows feedback circuit 27 including reference cell 28 and feedback signal generator 29. The concept of the feedback circuit 27 is to isolate a reference cell such that it is affected by aqueous mixture physical characteristic changes other than the physical characteristic that is desired to be sensed by the system. For instance, if water weight is desired to be sensed then the water weight is kept constant so that any voltage changes generated by the reference cell are due to physical characteristics other than water weight changes. In one embodiment, reference cell 28 is immersed in an aqueous mixture of recycled water which has the same chemical and temperature characteristics of the water in which cell array 24 is immersed in. Hence, any chemical or temperature changes affecting conductivity experienced by array 24 is also sensed by reference cell 28. Furthermore, reference cell 28 is configured such that the weight of the water is held constant. As a result voltage changes Vout (ref. cell) generated by the reference cell 28 are due to changes in the conductivity of the aqueous mixture, not the weight. Feedback signal generator 29 converts the undesirable voltage changes produced from the reference cell into a feedback signal that either increases or decreases Vin and thereby cancels out the affect of erroneous voltage changes on the sensing system. For instance, if the conductivity of the aqueous mixture in the array increases due to a temperature increase, then Vout (ref. cell) will decrease causing a corresponding increase in the feedback signal. Increasing Vfeedback increases Vin which, in turn, compensates for the initial increase in conductivity of the aqueous mixture due to the temperature change. As a result, Vout from the cells only change when the weight of the aqueous mixture changes.

Figure 6A:
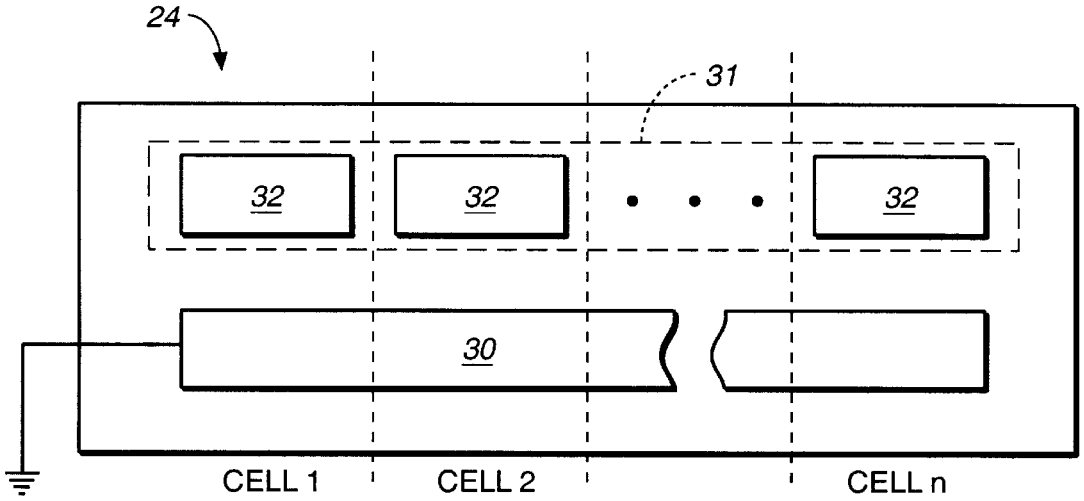
FIGS. 6A and 6B show a second embodiment of a sensor array and an equivalent electrical representation.
Figure 6B:
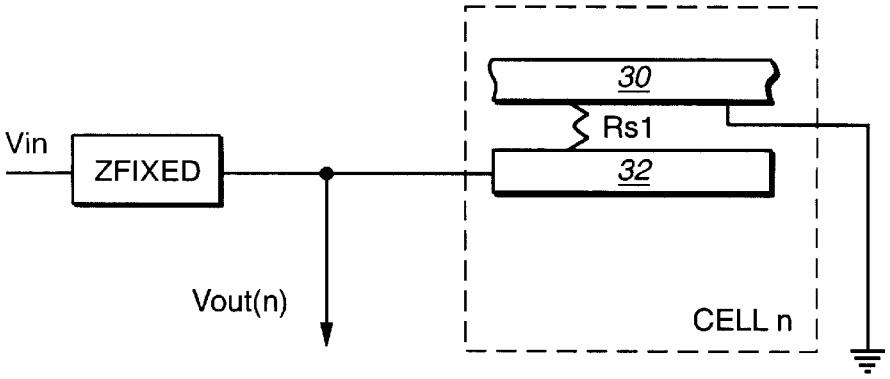

One reason for configuring the cell array as shown in FIG. 5A, with the center electrode placed between two grounded electrodes, is to electrically isolate the center electrode and to prevent any outside interaction between the center electrode and other elements within the system. However, it should also be understood that the cell array can be configured with only two electrodes. FIG. 6A shows a second embodiment of the cell array for use in the sensor. In this embodiment, the sensor includes a first grounded elongated electrode 30 and a second partitioned electrode 31 including sub-electrodes 32. A single cell is defined as including one of the sub-electrodes 32 and the portion of the grounded electrode 30 which is adjacent to the corresponding sub-electrode. FIG. 6A shows cells 1–n each including a sub-electrode 32 and an adjacent portion of electrode 30. FIG. 6B shows a single cell n, wherein the sub-electrode 32 is coupled to Vin from the signal generator 25 through a fixed impedance element Zfixed and an output signal Vout is detected from the sub-electrode 32. It should be apparent that the voltage detected from each cell is now dependent on the voltage divider network, the variable impedance provided from each cell and the fixed impedance element coupled to each sub-electrode 32. Hence, changes in conductance of each cell is now dependent on changes in conductance of Rs1. The remainder of the sensor functions in the same manner as with the embodiment shown in FIG. 6A. Specifically, the signal generator provides a signal to each cell and feedback circuit 27 compensates Vin for variations in conductance that are not due to the characteristic being measured.

Figure 7A:
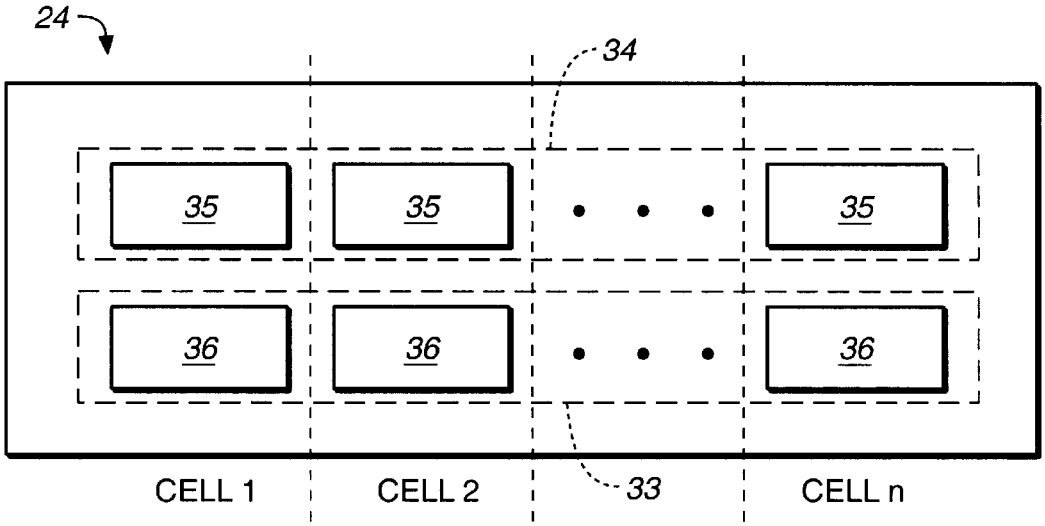
FIGS. 7A and 7B show a third embodiment of a sensor array and an equivalent electrical representation.
Figure 7B:
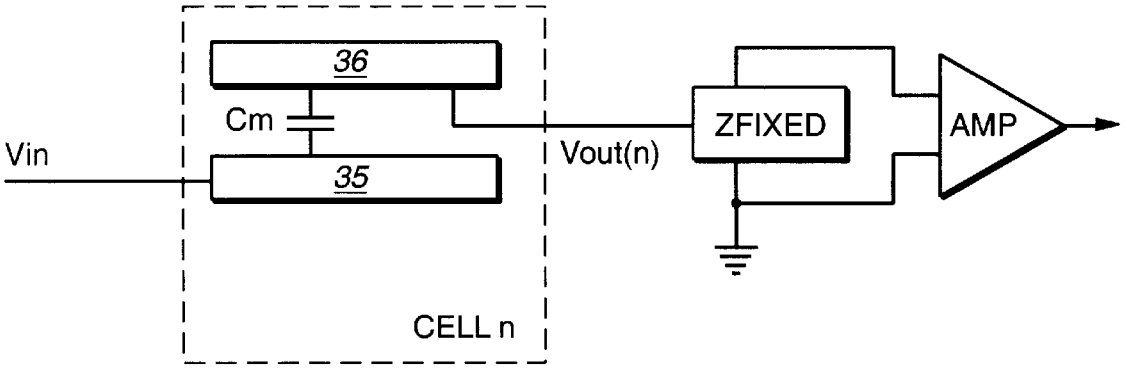

In still another embodiment of the cell array shown in FIGS. 7A and 7B, the cell array includes first and second elongated spaced apart partitioned electrodes 33 and 34, each including first and second sets of sub-electrodes 36 and 35, (respectively). A single cell (FIG. 7B) includes pairs of adjacent sub-electrodes 35 and 36, wherein sub-electrode 35 in a given cell is independently coupled to the signal generator and sub-electrode 36 in the given cell provides Vout to a high impedance detector amplifier which provides Zfixed. This embodiment is useful when the material residing between the electrodes functions as a dielectric making the sensor impedance high. Changes in voltage Vout is then dependent on the dielectric constant of the material. This embodiment is conducive to being implemented at the dry end of a sheetmaking machine (and particularly beneath and in contact with the dry sheet since dry paper has high resistance and its dielectric properties are easier to measure.

Hence, a system and method for measuring turbulence using water weight measurements and controlling turbulence is described.

It should be understood that although the invention will be described as part of a fourdrinier sheetmaking machine, the invention is applicable to other sheetmaking machines including, for example, twin wire and multiple headbox machines and to paper board formers such as cylinder machines or Kobayshi Formers. Some conventional elements of a sheetmaking machine are omitted in the following disclosure in order not to obscure the description of the elements of the present invention.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A measurement system for measuring the intensity level of turbulence of wetstock in a sheetmaking machine, said sheetmaking machine including a conveyer for moving and providing drainage of said wetstock, said system comprising:

a means for obtaining multiple-point simultaneous wet-end water weight measurement readings of said wetstock, said measurement obtaining means being positioned in close proximity to said conveyer;

means for correlating said water weight measurement readings into turbulence measurements by correlating ranges of water weight of said water weight measurement readings to predefined turbulence intensity level intervals.

2. The system as described in claim 1 wherein said turbulence measurements are provided on-line in a manufacturing environment.

3. The system as described in claim 1 wherein said water weight measurement reading obtaining means includes a plurality of sensors each for individually accumulating water weight measurement readings.

4. The system as described in claim 1 wherein said correlation means includes means for sorting said accumulated water weight measurement readings into said ranges of water weight.

5. The system as described in claim 3 wherein said plurality of sensors are arranged along the machine direction of said sheetmaking machine.

6. The system as described in claim 3 wherein said plurality of sensors are arranged along the cross direction of said sheetmaking machine.

7. The system as described in claim 3 wherein said sheetmaking machine includes in said wet-end a traveling drainage conveyer and wherein said plurality of sensors include first and second rows of sensors arranged on each side of said conveyer along the machine direction of said sheetmaking machine and a third row of sensors arranged essentially in the middle of said conveyer along the machine direction.

8. The system as described in claim 3 wherein said correlating means determines a single turbulence value corresponding to each of said plurality of sensors from said accumulated water weight measurement readings taken during a given measurement time period.

9. A control system for providing turbulence adjustments of wetstock in a sheetmaking machine which includes turbulence adjusting elements and a conveyer for moving and providing drainage of said wetstock, said system comprising:

a means for obtaining multiple-point simultaneous wet-end water weight measurement readings of said wetstock, said measurement obtaining means being positioned in close proximity to said conveyer;

means for correlating said water weight measurement readings into turbulence measurements by correlating ranges of water weight of said water weight measurement readings to predefined turbulence intensity level intervals;

means for generating turbulence control signals for providing control to said turbulence adjusting elements in response to target turbulence information and said turbulence measurement information.

10. The control system as described in claim 9 wherein said control is provided on-line in a manufacturing environment.

11. The control system as described in claim 9 wherein said turbulence control signals include machine direction turbulence control signals for controlling machine direction turbulence adjusting elements.

12. The control system as described in claim 9 wherein said turbulence control signals include cross direction turbulence control signals for controlling cross direction turbulence adjusting elements.

13. The control system as described in claim 9 wherein said measurement means includes a plurality of sensors each for individually accumulating water weight measurement readings.

14. The control system as described in claim 9 wherein said correlation means includes means for sorting said accumulated water weight readings into said ranges of water weight.

15. The control system as described in claim 13 wherein said plurality of sensors are arranged along the machine direction of said sheetmaking machine.

16. The control system as described in claim 13 wherein said plurality of sensors are arranged along the cross direction of said sheetmaking machine.

17. The control system as described in claim 13 wherein said sheetmaking machine includes in said wet-end a traveling drainage conveyer and wherein said plurality of sensors include first and second rows of sensors arranged on each side of said conveyer along the machine direction and a third row of sensors arranged essentially in the middle of said conveyer along the machine direction.

18. The control system as described in claim 9 wherein said turbulence adjusting elements include a headbox having an associated headbox pressure dependent on at least one of an airpad, wetstock level, and pump pressure which are adjustable by controlling at least one of a pressure valve for adjusting said airpad, an intake valve for adjusting said wetstock level, and speed of said pump for adjusting said pump pressure with said control signals to perform said turbulence adjustments.

19. The control system as described in claim 9 wherein said turbulence adjusting elements include a headbox having an associated headbox dilution, and wherein said headbox includes a plurality of orifices with adjustable openings, wherein said headbox dilution is adjustable by individually controlling each of said orifice openings with said control signals to perform said turbulence adjustments.

20. The control system as described in claim 9 wherein said turbulence adjusting elements include a headbox having an associated headbox dilution, and wherein said headbox includes a plurality of orifices with adjustable openings, wherein said headbox dilution is adjustable by simultaneously controlling all of said orifice openings with said control signals to perform said turbulence adjustments.

21. The control system as described in claim 9 wherein said turbulence adjusting elements include a headbox having an associated headbox dilution which is adjustable by controlling a whitewater intake valve with said control signals to perform said turbulence adjustments.

22. The control system as described in claim 9 wherein said sheetmaking machine includes a headbox and a traveling drainage conveyer, and wherein said turbulence adjusting elements include said headbox having an associated headbox jet-to-wire ratio which is adjustable by controlling said drainage conveyer speed by controlling conveyer driver rollers with said control signals to perform said turbulence adjustments.

23. The control system as described in claim 9 wherein said sheetmaking machine includes a traveling drainage conveyer and wherein said turbulence adjusting elements include a forming board having an associated angular position relative to said drainage conveyer which is adjustable by controlling rapid hydraulic pistons with said control signals to perform said turbulence adjustments.

24. The control system as described in claim 9 wherein said turbulence adjusting elements include at least one vacuum box having an associate vacuum power which is adjustable by controlling said vacuum power with said control signals to perform said turbulence adjustments.

25. The control system as described in claim 9 wherein said sheetmaking machine includes a traveling drainage conveyer and wherein said turbulence adjusting elements include at least one foil having an associate vacuum power and turbulence effect which is adjustable by controlling angular position of said foil with respect to said drainage conveyer with said control signals to perform said turbulence adjustments.

26. The control system as described in claim 9 wherein said sheetmaking machine includes a traveling drainage conveyer having a means for shaking said traveling drainage conveyer, wherein said turbulence control signals control said shaking means to perform said turbulence adjustments.

27. The control system as described in claim 9 wherein said sheetmaking system includes a traveling drainage conveyer and wherein said turbulence adjusting elements include a headbox having a plurality of slices, each slice including a top lip portion and a bottom lip portion wherein the relative position of said top and bottom portions are indicated by an associated slice geometry ratio L/b, and wherein angle of impingement of wetstock on said traveling drainage conveyer from said headbox is adjustable by adjusting said geometry ratio with said control signals to perform said turbulence adjustments.

28. The control system as described in claim 9 wherein said sheetmaking machine includes a headbox having a plurality of slices each slice including a top lip having an associated stickdown position and wherein said stickdown position is adjustable with said control signals to perform said turbulence adjustments.

* * * * *